United States Patent [19]

Canup

[11] 4,077,380

[45] Mar. 7, 1978

[54] CONTROLLED-DURATION CONTINUOUS-WAVE HIGH-FREQUENCY IGNITION SYSTEM

[75] Inventor: Robert E. Canup, Chester, Va.

[73] Assignee: Texaco Inc., New York, N.Y.

[21] Appl. No.: 577,364

[22] Filed: May 14, 1975

[51] Int. Cl.[2] ..... F02P 1/00

[52] U.S. Cl. ..... 123/148 E; 123/146.5 A; 123/148 CB; 123/149 C

[58] Field of Search ..... 123/117 R, 146.5 A, 123/148 E, 148 CB, 149 C

[56] References Cited

U.S. PATENT DOCUMENTS

| | | | |
|---|---|---|---|
| 3,430,615 | 3/1969 | Chavis | 123/117 R |
| 3,626,910 | 12/1971 | Porsche et al. | 123/148 E |
| 3,736,463 | 5/1973 | Basso et al. | 123/148 CB |
| 3,838,328 | 9/1974 | Lundy | 123/148 CB |
| 3,903,856 | 9/1975 | McDougal et al. | 123/117 R |
| 3,913,550 | 10/1975 | Canup | 123/148 E |
| 3,973,545 | 8/1976 | Fischman et al. | 123/148 E |

*Primary Examiner*—Charles J. Myhre
*Assistant Examiner*—Parshotam S. Lall
*Attorney, Agent, or Firm*—Thomas H. Whaley; Carl G. Ries; Henry C. Dearborn

[57] ABSTRACT

An ignition system for internal combustion engines. It concerns an improvement for a controlled-duration continuous-wave high-frequency system, that has an output transformer with a control winding thereon. The system has an oscillator with the output transformer included therein. The oscillator generates spark energy, and an engine-timed unit controls an electronic switch that starts and stops the oscillator by breaking and making a loading circuit for the control winding. The improvement concerns a time constant element in electronic circuit means between the engine-timed unit and the electronic switch. The arrangement is such that the engine-timed unit controls the beginning of all spark intervals, and the end of each spark interval at less than a predetermined speed of the engine. But, only the time constant element controls the end of each spark interval at more than the predetermined speed of the engine.

5 Claims, 1 Drawing Figure

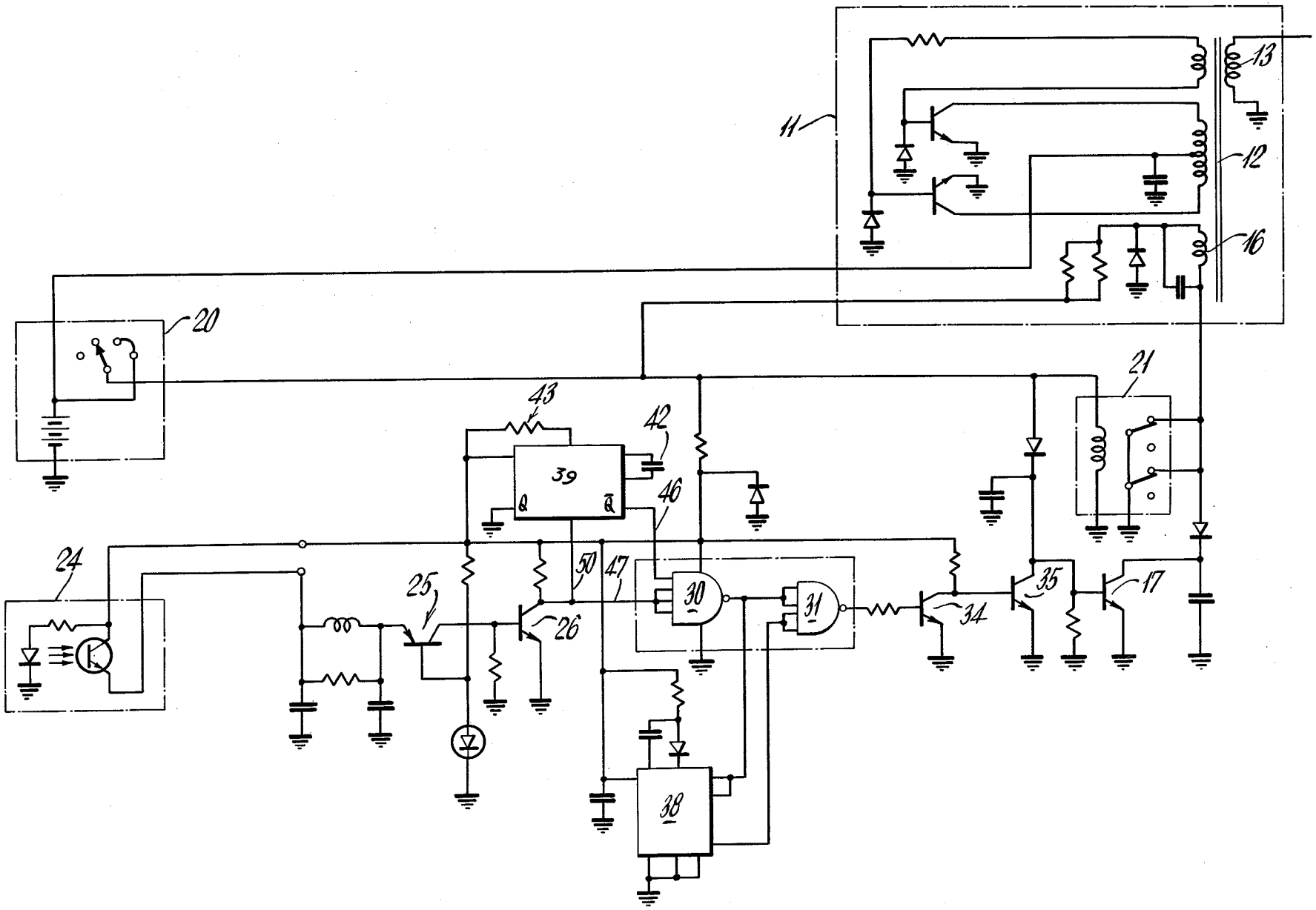
13
12
16
11
21
17
35
34
31
30
38
42
46
39
47
50
43
26
25
20
24

CONTROLLED-DURATION CONTINUOUS-WAVE HIGH-FREQUENCY IGNITION SYSTEM

CROSS-REFERENCE TO RELATED APPLICATION AND PATENTS

A co-pending application, Ser. No. 460,243 filed Apr. 11, 1974 now Pat. No. 3,913,550 (D#73,508) discloses a basically similar ignition system. Similarily, U.S. Pat. Nos. 3,792,695 issued Feb. 19, 1974 and 3,861,369 issued Jan. 21, 1975 discloses an ignition system and the control element portion thereof, respectively. These are like corresponding parts of the subject application.

BACKGROUND OF THE INVENTION

1. Field of the Invention

This invention concerns ignition systems, in general. More specifically, it relates to an improvement that is applicable to an ignition system for internal combustion engines, which system employs controlled-duration continuous-wave high-frequency spark energy.

2. Description of the Prior Art

While the above noted type of ignition system has been developed and found quite satisfactory, it has been observed that during high speed operation of internal combustion engines the engine-timed spark signal control which is related to crank shaft angle, becomes quite short in time duration. Consequently, at such high speeds the sparking signal duration for this type of ignition system, may be less than such signal as developed by the more conventional one-shot type of spark signal. Thus, the high-frequency continuous-wave oscillator type of spark signal tends to become somewhat less effective than the more common one-shot spark which is not terminated by a crank shaft angle control but only initiated by such timing.

Consequently, it is an object of this invention to provide the ability for a controlled-duration continuous wave high frequency system to have increase spark duration at high RPM so that the ability to operate satisfactorily on lean mixtures will be enhanced.

SUMMARY OF THE INVENTION

Briefly, this invention concerns an ignition system that is in combination with an internal combustion engine. The ignition system employs controlled-duration continuous-wave high-frequency spark energy. The said spark energy is generated by an oscillator having an output transformer and having a control winding thereon for starting and stopping oscillation of said oscillator at the beginning and end of each spark interval. It also has electronic switch means connected in series with said control winding for breaking and making a loading circuit which includes said control winding, and engine-timed means for controlling said electronic switch means. It also includes electronic circuit means which comprises time constant means for connecting said engine-timed means to said electronic switch means. Said spark intervals are initiated and terminated by said engine-timed means at less than a predetermined speed of said engine and terminated by said time constant means at more than said predetermined speed.

Again briefly, the invention concerns an ignition system that is in combination with an internal combustion engine. The said system employs controlled-duration continuous-wave high-frequency spark energy. The said spark energy is generated by an oscillator which has an output transformer and has a control winding thereon for starting and stopping oscillation of said oscillator at the beginning and end of each spark interval. There is electronic switch means connected in series with said control winding for breaking and making a loading circuit which includes said control winding, and engine-timed means for controlling said electronic switch means. There also is electronic circuit means for connecting said engine-timed means to said electronic switch means. Said electronic circuit means comprises a one-shot multivibrator having a predetermined time constant longer than each of said spark intervals at maximum speed of said engine and shorter than said intervals at minimum speed. It also comprises a NOR gate having an output and two inputs, and first circuit means for connecting said engine-timed means to the input of said one-shot multivibrator and to one of said NOR gate inputs. It also comprises second circuit means for connecting the output of said one-shot multivibrator to the other end of said NOR gate inputs, and third circuit means for connecting the output of said NOR gate to said electronic switch means for controlling said spark intervals.

BRIEF DESCRIPTION OF THE DRAWING

The foregoing and other objects and benefits of the invention will be more fully set forth below in connection with the best mode contemplated by the inventor of carrying out the invention, and in connection with which there is an illustration provided in the drawing wherein:

The FIGURE of drawing is a schematic circuit diagram illustrating an ignition system in accordance with the invention.

DESCRIPTION OF THE PREFERRED EMBODIMENT

Referring to the drawing, it will be observed that the total ignition system is quite similar to the co-pending application mentioned above. Thus, there is an oscillator 11 that is shown enclosed in dashed lines. The oscillator includes a transformer 12. Transformer 12 is the output transformer that delivers the controlled-duration continuous-wave high-frequency spark energy which is developed and is supplied to the spark plugs (not shown) of an integral combustion engine (not shown) via an output winding 13 on the transformer 12.

Also in connection with the oscillator 11, there is a control winding 16 on the transformer 12. This winding 16 acts to control starting and stopping of the oscillation of the oscillator 11. There is a transistor 17 that acts as an electronic switch means, and it is connected in series with the control winding 16. Consequently, the state of conduction or non-conduction of transistor 17 controls the oscillation or non-oscillation of oscillator 11. The oscillation periods determine the sparking intervals for the engine.

When the transistor 17 conducts, it completes a loading circuit which prevents the oscillator 11 from oscillating. Then, when the conduction of transistor 17 is cut off, it breaks the loading circuit and also acts to cut off a DC bias current that is flowing through the control winding 16. This insures that the oscillator will start instantaneously at the moment when the transistor 17 goes non-conducting. The details of such operation for this type of ignition system are clearly described and set forth in the above noted co-pending application, taken with the already issued patents also mentioned above.

It may be noted that there is an ignition switch unit 20 which acts to energize the control circuitry for the electronic switch transistor 17. At the same time it actuates a relay unit 21 that puts a direct short circuit across the control winding 16 of the oscillator 11 whenever the ignition switch in unit 20 is turned off.

Also, there is an engine-timed unit 24 that is illustrated as a photoelectric type. This is like the unit shown and described in the above noted co-pending application, or some of the engine-timed units shown in the U.S. Pat. No. 3,861,369. The unit 24 is controlled by a shutter arrangement (not shown) on the distributor rotor of the engine, and acts to provide signals similar to those which would be provided by conventional breaker points of the ordinary automotive distributor.

The engine-timed unit 24 controls the electronic switch means, i.e. transistor 17, by electronic circuit elements that are connected there-between. The principal elements of this circuitry are like those shown and described in the above mentioned U.S. Pat. No. 3,861,369, so that these need not be described in greater detail here. The engine-timed unit 24 has the shutter (not shown) of the distributor arranged to open for producing spark signal intervals. At such times there will be output signals from the unit 24 via a pair of transistors 25 and 26 to one input of a NOR gate 30. The output of NOR gate 30 goes via another gate element 31 that controls a pair of transistors 34 and 35 which in turn control the state of conduction or non-conduction of the electronic switch transistor 17.

There is a retriggerable multivibrator unit 38 that has an output into one of the inputs for the gate 31. However, its operation is not relevant to this invention. The details of the operation of this unit 38 are fully described in the above noted U.S. Pat. No. 3,861,369.

As noted above, the problem which this invention overcomes is that relating to relatively high speed operation of internal combustion engines. Thus, an ignition system such as the type shown and described here (that has been also disclosed and described in various prior patents and applications assigned to the same assignee as this application) has the spark interval determined by a predetermined crank shaft angle which is set by a shutter opening or breaker points opening. The shutter or breaker points are connected directly in a conventional manner to the crank shaft of the engine.

While the high-frequency controlled duration continuous-wave type of spark signal is highly beneficial (particularity at lower engine speeds) because it maintains a spark that continues for the entire crank angle displacement, this has been found to have a drawn back that was unexpected, i.e. when the engine is running at high enough speeds so that the time duration for a spark signal is less than a spark signal would be under conventional one-shot type of spark signal. This invention overcomes that difficulty by providing a control that will give a minimum spark duration time that may be predetermined for any desired time duration. Consequently, it will be set to be longer than the short time period otherwise encountered at high RPM of the engine. This is accomplished by providing a one-shot multivibrator element 39 that has an exterior capacitor 42 and resistor 43 connected to the integrated circuit element in order to predetermine the time period of the one-shot multivibrator operation. It will be understood that a one-shot multivibrator switches from one output signal state to another when an input signal is received, and then switches the output back automatically after a time constant as determined by the values of the capacitor and resistor elements.

The multivibrator element 39 has an output circuit connection 46 that goes to one input of the NOR gate 30. The gate 30 has another input circuit connection 47 that leads from the output of the transistor 26, which also has a circuit connection 50 from its output to an input of the one-shot multivibrator element 39.

OPERATION

It may be observed that the operation of the system in accordance with this invention is such that at or below a predetermined speed of the internal combustion engine, the signal for controlling spark duration will be determined by the engine timed unit 24 for the beginning and end of each spark signal duration. Thus, as already indicated, when the shutter (not shown) permits signals to pass at the unit 24 the signals developed by the light sensitive transistor will be transmitted to the transistor pair 25 and 26, for amplification. Then these signals continue in the control circuitry via the NOR gate 30 and the gate 31 to the transistors 34 and 35, so as to control the state of conduction of the electronic switch element 17.

However, the NOR gate 30 will pass desired control signals, i.e. will change state, when either of the inputs from the circuit connection 47 or 46 are in the proper state. Consequently, if the shutter control signal from unit 24 lasts for less than a predetermined time-duration, i.e. that set by the circuit constants as determined by capacitor 42 and resistor 43 of the one-shot 39, the output of gate 30 will not change state at the end of the crank shaft angle signal from the unit 24 so long as there is the signal applied at the other input over the circuit connection 46 from the multivibrator unit 39. Therefore, at any speeds above a predetermined RPM the spark signals will continue for a longer period than that determined by the preset crank angle degrees as determined by shutter openings. This means that the spark signals will be more complete having a minimum duration for avoiding any possible misfire or incomplete combustion of the mixture in the cylinders.

In other words, at lower speeds than a predetermined RPM, the one-shot multivibrator element 39 will not be effective because its signal change at the output circuit 46 will be overridden by the output signal over circuit 47 from the engine-timed unit 24, and consequently the NOR gate 30 will not change state. This means that the spark signal will continue for the desired full crank angle degree time at the lower speeds and benefits of the continuous high-frequency type of spark signal will be had at the lower engine speeds. Then, when the engine speed exceeds the predetermined RPM instead of the spark signal being shorter in time duration because the crank angle time period is so much less, it will continue for a predetermined time as determined by the one-shot multivibrator 39 and thus a more adequate spark signal will be supplied at high RPM than otherwise would be the case.

While a particular embodiment of the invention has been described above in considerable detail, in accordance with the applicable statues, this is not to be taken as in any way limiting the invention but merely as being descriptive thereof.

I claim:

1. In combination with an internal combustion engine, an ignition system wherein said system employs controlled-duration continuous-wave high-frequency spark energy, said spark energy being generated by an oscillator having an output transformer and having a control winding thereon for starting and stopping oscillation of said oscillator at the beginning and end of each spark interval, electronic switch means connected in series with said control winding for breaking and making a load circuit which includes said control winding, engine-timed means for controlling said electronic switch means, and electronic circuit means comprising time constant means for connecting said engine-timed means to said electronic switch means, said spark intervals being initiated and terminated by said engine-timed means at less than a predetermined speed of said engine and terminated by said time constant means at more than said predetermined speed.

2. The invention according to claim 1, wherein said time constant means comprises a one-shot multivibrator.

3. The invention according to claim 2, wherein said electronic circuit means also comprises a NOR gate having two inputs, said engine-timed means being connected to the input of said one-shot multivibrator and to one of said NOR gate inputs, and the output of said one-shot multivibrator being connected to the other of said NOR gate inputs.

4. The invention according to claim 4, wherein said one-shot multivibrator has a predetermined time constant that is longer than each of said spark intervals when said engine exceeds a predetermined revolutions per minute.

5. In combination with an internal combustion engine, an ignition system wherein said system employs controlled-duration continuous-wave high-frequency spark energy, said spark energy being generated by an oscillator having an output transformer and having a control winding thereon for starting and stopping oscillation of said oscillator at the beginning and end of each spark interval, electronic switch means connected in series with said control winding for breaking and making a loading circuit which includes said control winding, engine-timed means for controlling said electronic switch means, and electronic circuit means for connecting said engine-timed means to said electronic switch means, said electronic circuit means comprising a one-shot multivibrator having a predetermined time constant longer than each of said spark intervals at maximum speed of said engine and shorter than said intervals at minimum speed, a NOR gate having an output and two inputs, first circuit means for connecting said engine-timed means to the input of said one-shot multivibrator and to one of said NOR gate inputs, second circuit means for connecting the output of said one-shot multivibrator to the other end of said NOR gate inputs, and third circuit means for connecting the output of said NOR gate to said electronic switch means for controlling said spark intervals.

* * * * *